US010658105B2

(12) United States Patent
Yoshida et al.

(10) Patent No.: US 10,658,105 B2
(45) Date of Patent: May 19, 2020

(54) REACTOR HAVING IRON CORES AND COILS

(71) Applicant: FANUC CORPORATION, Minamitsuru-gun, Yamanashi (JP)

(72) Inventors: Tomokazu Yoshida, Yamanashi (JP); Masatomo Shirouzu, Yamanashi (JP); Kenichi Tsukada, Yamanashi (JP)

(73) Assignee: FANUC CORPORATION, Yamanashi (JP)

( * ) Notice: Subject to any disclaimer, the term of this patent is extended or adjusted under 35 U.S.C. 154(b) by 0 days.

(21) Appl. No.: 16/003,452

(22) Filed: Jun. 8, 2018

(65) Prior Publication Data

US 2018/0366268 A1 Dec. 20, 2018

(30) Foreign Application Priority Data

Jun. 16, 2017 (JP) ..... 2017-118522

(51) Int. Cl.

| | |
|---|---|
| ***H01F 27/40*** | (2006.01) |
| ***H01F 37/00*** | (2006.01) |
| ***H01F 3/14*** | (2006.01) |
| ***H01F 27/245*** | (2006.01) |
| ***H01F 27/28*** | (2006.01) |

(52) U.S. Cl.

CPC ..... *H01F 27/402* (2013.01); *H01F 3/14* (2013.01); *H01F 27/245* (2013.01); *H01F 27/28* (2013.01); *H01F 37/00* (2013.01); *H01F 2027/406* (2013.01)

(58) Field of Classification Search

CPC ..... H01F 27/402; H01F 27/245; H01F 2027/406; H01F 27/28; H01F 3/14

USPC ..... 336/5, 55, 179

See application file for complete search history.

(56) References Cited

U.S. PATENT DOCUMENTS

| | | | | |
|---|---|---|---|---|
| 3,644,767 | A * | 2/1972 | Kasargod | H01F 29/08 310/216.008 |
| 10,141,102 | B2 | 11/2018 | Inaba et al. | |
| 2006/0279389 | A1* | 12/2006 | Baumbach | F01L 9/04 335/272 |
| 2009/0261939 | A1* | 10/2009 | Shudarek | H01F 3/10 336/212 |
| 2016/0125998 | A1* | 5/2016 | Bhide | H01F 37/00 336/5 |
| 2017/0040099 | A1 | 2/2017 | Bhide et al. | |
| 2017/0084377 | A1 | 3/2017 | Maeda et al. | |
| 2017/0294267 | A1* | 10/2017 | Kodama | H01F 1/153 |

(Continued)

FOREIGN PATENT DOCUMENTS

| | | | |
|---|---|---|---|
| CN | 101394691 | A | 3/2009 |
| CN | 201765902 | U | 3/2011 |
| CN | 201859733 | U | 6/2011 |

(Continued)

*Primary Examiner* — Tszfung J Chan
(74) *Attorney, Agent, or Firm* — RatnerPrestia

(57) ABSTRACT

A core body of a reactor includes an outer peripheral iron core composed of a plurality of outer peripheral iron core portions, at least 3 iron cores coupled to the outer peripheral iron core portions, and coils wound onto the at least three iron cores. Gaps are formed between one of the at least three iron cores and another iron core adjacent thereto. Further, the reactor includes a temperature detection part arranged in the center of one end surface of the core body.

8 Claims, 7 Drawing Sheets

(56) References Cited

U.S. PATENT DOCUMENTS

2017/0352476 A1 12/2017 Inaba et al.

FOREIGN PATENT DOCUMENTS

| | | | | | |
|---|---|---|---|---|---|
| CN | 105225800 | A | | 1/2016 | |
| CN | 107004497 | A | | 8/2017 | |
| DE | 102016010901 | A1 | | 3/2017 | |
| JP | H02-203507 | A | | 8/1990 | |
| JP | 2007173700 | A | | 7/2007 | |
| JP | 2016122760 | A | * | 7/2016 | ..... H01F 37/00 |
| JP | 2016122760 | A | | 7/2016 | |

* cited by examiner $\pi/6$ $\pi/3$ $\pi/2$ $2\pi/3$ $5\pi/6$ $\pi$

REACTOR HAVING IRON CORES AND COILS

CROSS-REFERENCE TO RELATED APPLICATION

This application is a new U.S. patent application that claims benefit of Japanese Patent Application No. 2017-118522, filed Jun. 16, 2017, the disclosure of this application is being incorporated herein by reference in its entirety for all purposes.

BACKGROUND OF THE INVENTION

1. Field of the Invention

The present invention relates to a reactor having iron cores and coils.

2. Description of Related Art

In the prior art, reactors include three coils, which are opposite of each other. Refer to, for example, Japanese Unexamined Patent Publication (Kokai) No. 2-203507. The iron core of a convention prior art reactor is typically of a substantially E-shape having two outer legs and a central leg disposed therebetween. Coils are wound onto each of the two outer legs and the central leg.

SUMMARY OF THE INVENTION

Iron cores generate heat when the reactor is driven. However, the temperature of the iron core depends on load information and variations in heat dissipation, voltage, and current. Furthermore, in the case of a reactor including a substantially E-shaped iron core, the temperatures of the two outer legs and the central leg differ, and generally, the temperature is highest at the proximal end of the central leg. Thus, in order to accurately understand the state of heat generation of a reactor including a substantially E-shaped iron core, it is necessary to arrange temperature detection parts on all of the two outer legs and the central leg. As a result, the cost increases due to the plurality of temperature detection parts.

Thus, a reactor in which the temperatures thereof can be easily understood through the use of a single temperature detection part is desired.

According to a first aspect of the present disclosure, there is provided a reactor comprising a core body, the core body comprising an outer peripheral iron core composed of a plurality of outer peripheral iron core portions, at least three iron cores coupled to the plurality of outer peripheral iron core portions, and coils wound onto the at least three iron cores, wherein gaps, which can be magnetically coupled, are formed between one of the at least three iron cores and another iron core adjacent thereto, the reactor further comprising a temperature detection part arranged in the center of one end surface of the core body.

In the first aspect, the temperature of each component of the reactor can be detected by the single temperature detection part. Further, since a single temperature detection part is sufficient, it is possible to prevent an increase in cost.

The object, features, and advantages of the present invention, as well as other objects, features and advantages, will be further clarified by the detailed description of the representative embodiments of the present invention shown in the accompanying drawings.

DETAILED DESCRIPTION

Figure 1A:
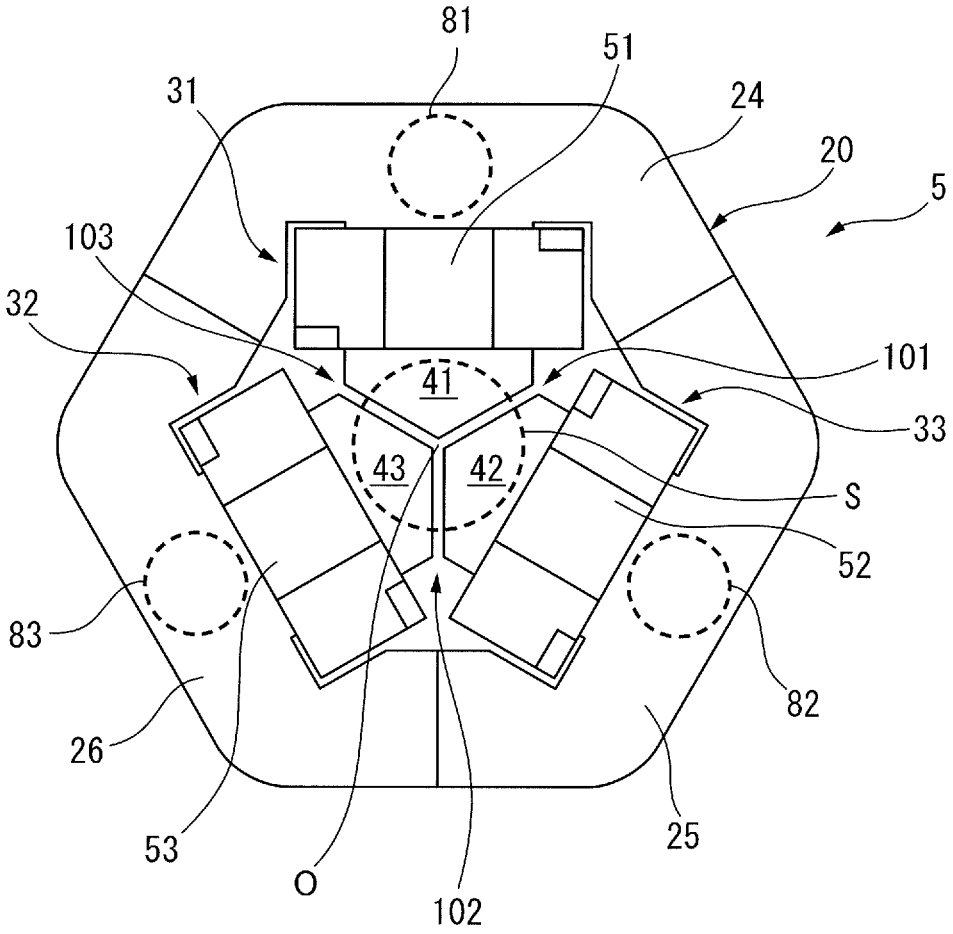
FIG. 1A is an end view of a reactor according to a first embodiment.

The embodiments of the present invention will be described below with reference to the accompanying drawings. In the following drawings, the same components are given the same reference numerals. For ease of understanding, the scales of the drawings have been appropriately modified.

In the following description, a three-phase reactor will be mainly described as an example. However, the present disclosure is not limited in application to a three-phase reactor, but can be broadly applied to any multiphase reactor requiring constant inductance in each phase. Further, the reactor according to the present disclosure is not limited to those provided on the primary side or secondary side of the inverters of industrial robots or machine tools, but can be applied to various machines.

Figure 1B:
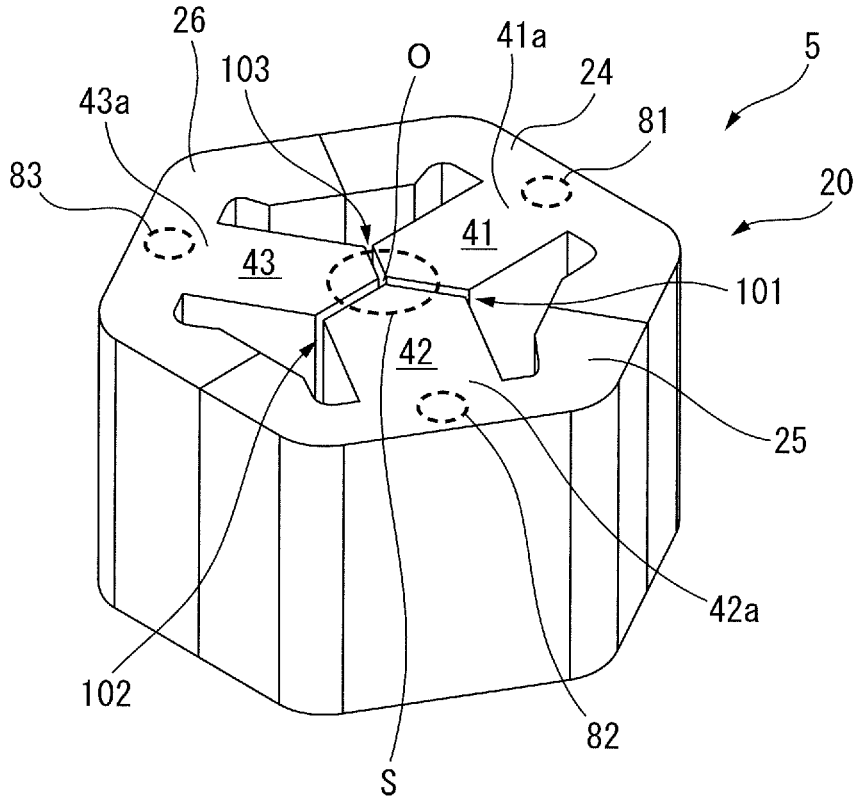
FIG. 1B is a partial perspective view of the reactor shown in FIG. 1A.

FIG. 1A is an end view of a reactor based on the first embodiment, and FIG. 1B is a partial perspective view of the reactor shown in FIG. 1A. As shown in FIG. 1A and FIG. 1B, a core body 5 of a reactor 6 includes an annular outer peripheral iron core 20 and at least three iron core coils 31 to 33 arranged inside the outer peripheral core 20 at equal intervals in the circumferential direction. Furthermore, it is preferable that the number of the iron cores be a multiple of three, whereby the reactor 6 can be used as a three-phase reactor. Note that the outer peripheral iron core 20 may have another shape, such as a circular shape. The iron core coils 31 to 33 include iron cores 41 to 43 and coils 51 to 53 wound onto the iron cores 41 to 43, respectively.

The outer peripheral iron core 20 is composed of a plurality of, for example, three, outer peripheral iron core portions 24 to 26 divided in the circumferential direction. The outer peripheral iron core portions 24 to 26 are formed integrally with the iron cores 41 to 43, respectively. The outer peripheral iron core portions 24 to 26 and the iron cores 41 to 43 are formed by stacking a plurality of iron plates, carbon steel plates, or electromagnetic steel sheets, or are formed from a dust core. When the outer peripheral iron core 20 is formed from a plurality of outer peripheral iron core portions 24 to 26, even if the outer peripheral iron core 20 is large, such an outer peripheral iron core 20 can be easily manufactured. Note that the number of iron cores 41 to 43 and the number of iron core portions 24 to 26 need not necessarily be the same.

As can be understood from FIG. 1A, the iron cores 41 to 43 are approximately the same size and are arranged at approximately equal intervals in the circumferential direction of the outer peripheral iron core 20. In FIG. 1A, the radially outer ends of the iron cores 41 to 43 are coupled to the iron core portions 24 to 26, respectively.

Further, the radially inner ends of the iron cores 41 to 43 converge toward the center of the outer peripheral iron core 20, and the tip angles thereof are approximately 120 degrees. The radially inner ends of the iron cores 41 to 43 are separated from each other via gaps 101 to 103, which can be magnetically coupled.

In other words, in the first embodiment, the radially inner end of the iron core 41 is separated from the radially inner ends of the two adjacent iron cores 42 and 43 via gaps 101 and 103. The same is true for the other iron cores 42 and 43. It is ideal that the sizes of the gaps 101 to 103 be equal to each other, but they may not be equal. As can be understood from FIG. 1A, the point of intersection of the gaps 101 to 103 is located at the center of the reactor 6. The core body 5 is formed with radial symmetry about this center.

In the first embodiment, the iron core coils 31 to 33 are arranged inside the outer peripheral iron core 20. In other words, the iron core coils 31 to 33 are surrounded by the outer peripheral iron core 20. Thus, leakage of magnetic flux from the coils 51 to 53 to the outside of the outer peripheral iron core 20 can be reduced.

FIG. 2A through FIG. 2F show the magnetic flux density of the reactor of the first embodiment. FIG. 3 shows the relationship between phase and current. In FIG. 3, the iron cores 41 to 43 of the reactor 6 of FIG. 1A are set as the R-phase, S-phase, and T-phase, respectively. Further, in FIG. 3, the current of the R-phase is indicated by the dotted line, the current of the S-phase is indicated by the solid line, and the current of the T-phase is indicated by the dashed line.

Figure 2A:
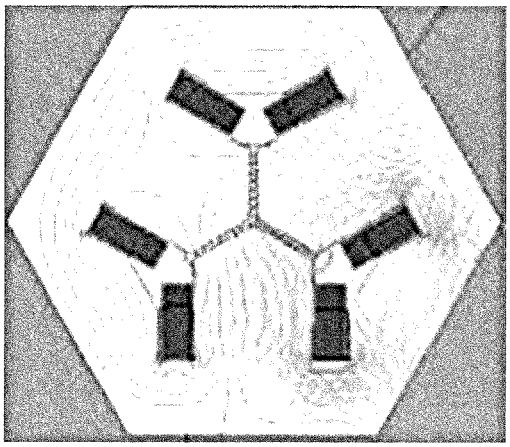
FIG. 2A is a first view showing the magnetic flux density of the reactor of the first embodiment.
Figure 2B:
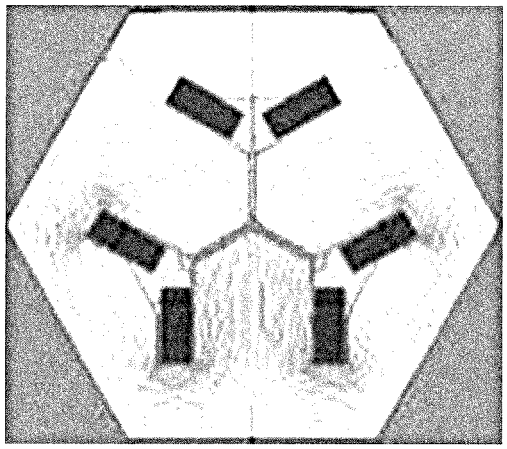
FIG. 2B is a second view showing the magnetic flux density of the reactor of the first embodiment.
Figure 2C:
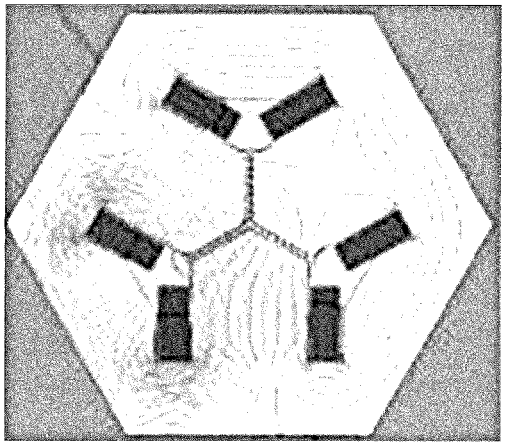
FIG. 2C is a third view showing the magnetic flux density of the reactor of the first embodiment.
Figure 2D:
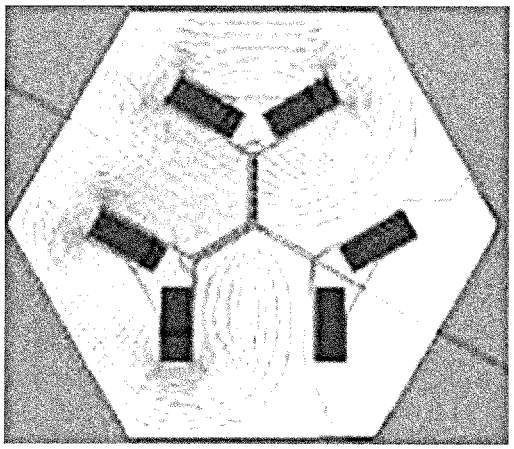
FIG. 2D is a fourth view showing the magnetic flux density of the reactor of the first embodiment.
Figure 2E:
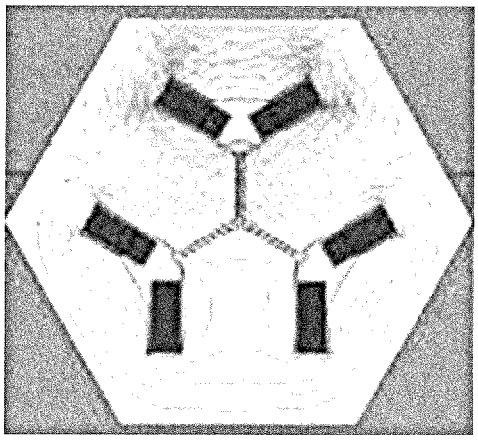
FIG. 2E is a fifth view showing the magnetic flux density of the reactor of the first embodiment.
Figure 2F:
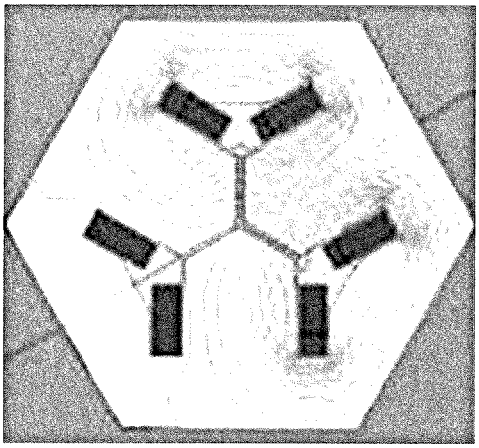
FIG. 2F is a sixth view showing the magnetic flux density of the reactor of the first embodiment.
Figure 3:
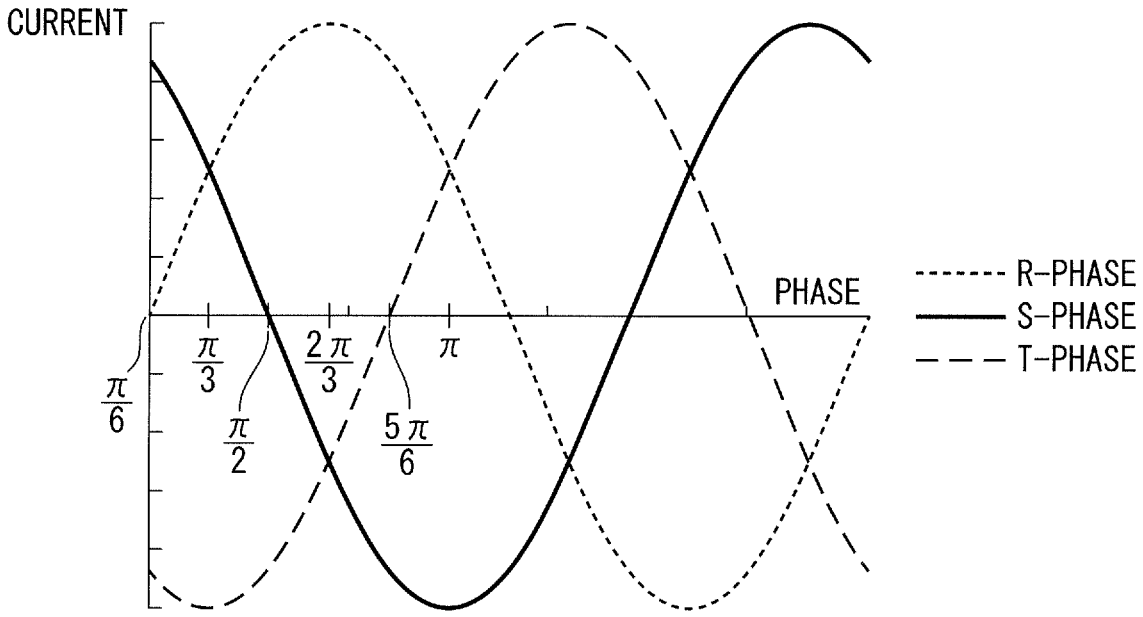
FIG. 3 is a diagram showing the relationship between phase and current.

In FIG. 3, when the electrical angle is $\pi/6$, the magnetic flux density shown in FIG. 2A is obtained. Likewise, when the electrical angle is $\pi/3$, the magnetic flux density shown in FIG. 2B is obtained. When the electrical angle is $\pi/2$, the magnetic flux density shown in FIG. 2C is obtained. When the electrical angle is $2\pi/3$, the magnetic flux density shown in FIG. 2D is obtained. When the electrical angle is $5\pi/6$, the magnetic flux density shown in FIG. 2E is obtained. When the electrical angle is n, the magnetic flux density shown in FIG. 2F is obtained.

Referring again to FIG. 1A and FIG. 1B, a temperature detection part S is arranged in the center O of one end of the core body 5. It is preferable that the detector (not shown) of the temperature detection part S be arranged at the point of intersection of the gaps 101 to 103 (coincident with the center O of the core body 5). In this case, the detector may be arranged at the center O on an end surface of the core body 5, or may be arranged inside the core body 5 in line with the center O.

In one example, the outer shape of the temperature detection part S has a shape and area large enough to at least partially include the gaps 101 to 103. It is preferable that a circle including the radially outer ends of the gaps 101 to 103 on its circumference be the largest outer shape of the temperature detection part S. In this case, it is possible to make the temperature detection part S lighter, while preventing the temperature detection part S from interfering with the coils 51 to 53. Furthermore, in another example, the temperature detection part S may have a size such that it can be arranged only at the point of intersection of the gaps 101 to 103 (coincident with the center O of the core body 5).

Further, in FIG. 1B, outer end corresponding positions 81 to 83 corresponding to the respective radially outer ends 41*a* to 43*a* of the iron cores 41 to 43 are shown in the outer peripheral iron core 20. As shown in FIG. 2A through FIG. 2F, when the reactor 6 is driven, magnetic flux is not concentrated at the outer end corresponding positions 81 to 83. Thus, when the reactor 6 is driven, the temperatures at the outer end corresponding positions 81 to 83 are approximately equal to each other.

The shapes of the outer peripheral iron core portions 24 to 26 and the iron cores 41 to 43 are equal to each other, and are formed with rotational symmetry about the center of the core body 5. Further, the outer peripheral iron core portions 24 to 26 and the iron cores 41 to 43 are formed of the same material. Thus, the temperature gradients from the center O of one end of the core body 5 to the outer end corresponding positions 81 to 83 are equal to each other.

In other words, the temperatures at the outer end corresponding positions 81 to 83 depend on the temperature at the center O of one end of the core body 5, at least one of the current value and voltage value of the coils 51 to 53, and the material and dimensions of the outer peripheral iron core portions 24 to 26 and the iron cores 41 to 43. Thus, in the first embodiment, by detecting the temperature at the center O of one end of the core body 5 using the temperature detection part S, the temperature common between the outer end corresponding positions 81 to 83 can be estimated.

For the same reason, the temperatures of other positions of the core body 5, for example, the connection positions at which the adjacent peripheral iron core portions are connected to each other, can also be estimated based on the temperature at the center O of one end of the core body 5 detected by the temperature detection part S. In other words, in the first embodiment, using a single temperature detection part S, it is possible to accurately estimate the temperature of each of the portions of the reactor 6 based on the temperature at the center O of one end of the core body 5, at least one of the current value and voltage value of the coils 51 to 53, and the material and dimensions of the outer peripheral iron core portions 24 to 26 and the iron cores 41 to 43. Likewise, it is possible to estimate the temperature or the state of heat generation of the coils 51 to 53 of the reactor 6 using the single temperature detection part S.

Since only one temperature detection part S is necessary, it is possible to prevent an increase in cost as compared to the prior art. Note that the temperature detection part S may be arranged in the center of the other end of the reactor 6, or temperature detection part S may be arranged between the centers of both ends of the reactor 6.

The configuration of the core body 5 is not limited to the configuration shown in FIG. 1. Another configuration of the core body 5 in which the plurality of iron core coils are surrounded by the outer peripheral iron core 20 is included within the scope of the present disclosure.

Figure 4:
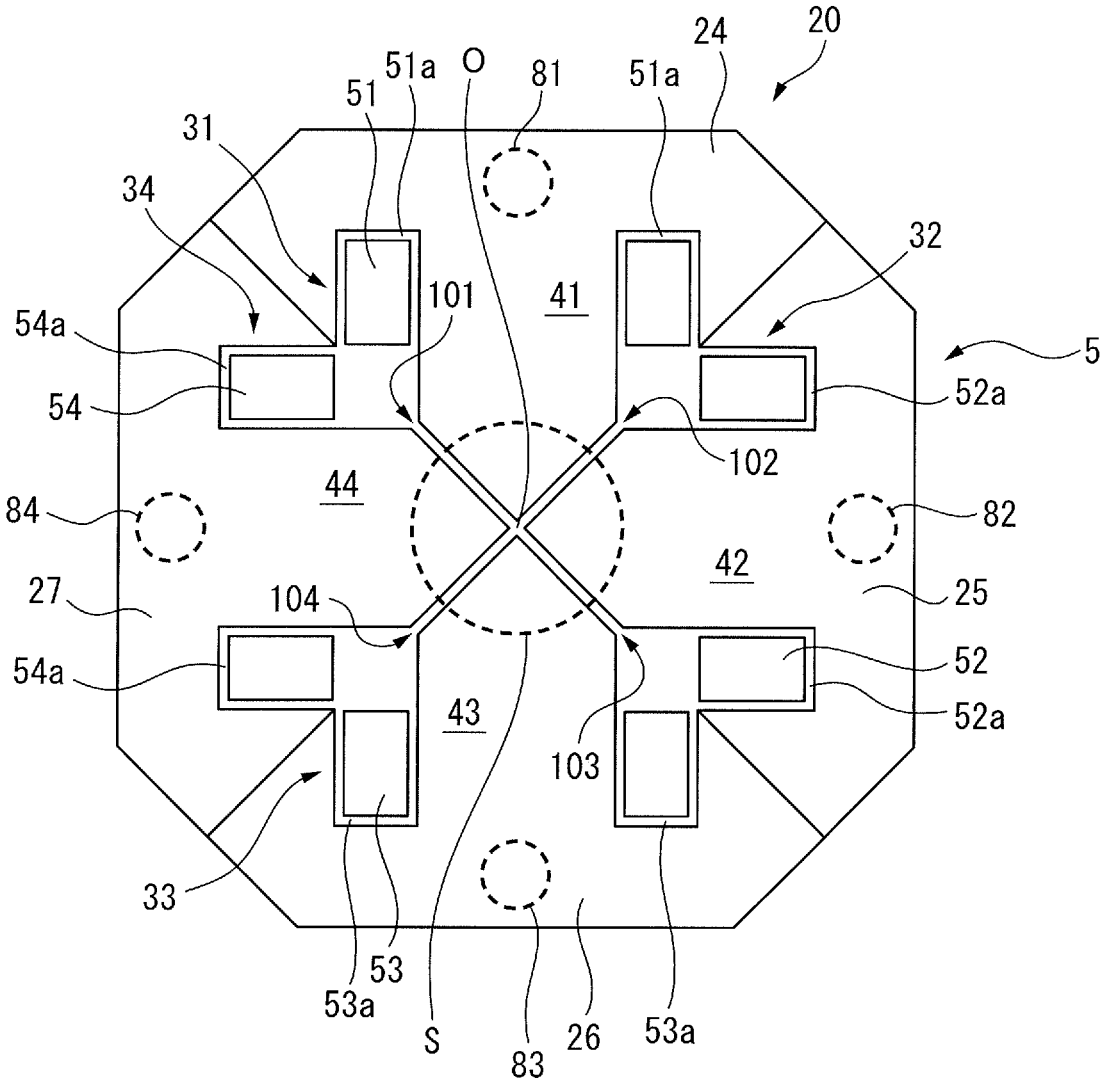
FIG. 4 is a cross-sectional view of a reactor according to a second embodiment.

FIG. 4 is a cross-sectional view of the reactor 6 of a second embodiment. The reactor 6 shown in FIG. 4 includes an outer peripheral iron core 20 composed of outer peripheral iron core portions 24 to 27, and four iron core coils 31 to 34, which are the same as the aforementioned iron core coils, arranged inside the outer peripheral iron core 20. These iron core coils 31 to 34 are arranged at substantially equal intervals in the circumferential direction of the reactor 6. Furthermore, the number of the iron cores is preferably an even number of 4 or more, so that the reactor 6 can be used as a single-phase reactor.

As can be understood from the drawing, the iron core coils 31 to 34 include iron cores 41 to 44 extending in the radial direction and coils 51 to 54 wound onto the respective iron cores, respectively. The radially outer ends of the iron cores 41 to 44 are integrally formed with the adjacent peripheral iron core portions 24 to 27, respectively.

Further, each of the radially inner ends of the iron cores 41 to 44 is located near the center of the outer peripheral iron core 20. In FIG. 4, the radially inner ends of the iron cores 41 to 44 converge toward the center of the outer peripheral iron core 20, and the tip angles thereof are about 90 degrees. The radially inner ends of the iron cores 41 to 44 are separated from each other via the gaps 101 to 104, which can be magnetically coupled.

As shown in FIG. 4, the temperature detection part S is arranged in the center O of one end of the core body 5. As described above, it is preferable that the detector (not shown) of the temperature detection part S be arranged at the point of intersection of the gaps 101 to 104 (coincident with the center O of the core body 5). The shapes of the outer peripheral iron core portions 24 to 27 and the iron cores 41 to 44 are equal to each other, and are formed with rotational symmetry about the center of the core body 5. Further, the outer peripheral iron core portions 24 to 26 and the iron cores 41 to 43 are formed of the same material, as described above. Thus, the temperature gradients from the center O of one end of the core body 5 to the outer end corresponding positions 81 to 84 are equal to each other. Therefore, for the same reasons as described above, using a single temperature detection part S, it is possible to accurately estimate the temperature of each of the positions of the reactor 6. Further, it can be understood that the same effects as described above can be obtained.

Aspects of the Disclosure

According to the first aspect, there is provided a reactor comprising a core body (5), the core body comprising an outer peripheral iron core (20) composed of a plurality of outer peripheral iron core portions (24 to 27), at least three iron cores (41 to 44) coupled to the plurality of outer peripheral iron core portions, and coils (51 to 54) wound onto the at least three iron cores, wherein gaps (101 to 104), which can be magnetically coupled, are formed between one of the at least three iron cores and another iron core adjacent thereto; the reactor further comprising a temperature detection part (S) arranged in the center of one end surface of the core body.

According to the second aspect, in the first aspect, the at least three iron cores of the core body are rotationally symmetrically arranged.

According to the third aspect, in the first or second aspect, the number of the at least three iron cores is a multiple of three.

According to the fourth aspect, in the first or second aspect, the number of the at least three iron cores is an even number not less than four.

Effects of the Aspects

In the first and second aspects, the temperature of each component of the reactor can be understood through the use of a single temperature detection part. Further, since a single temperature detection part is sufficient, it is possible to prevent an increase in cost.

In the third aspect, the reactor can be used as a three-phase reactor.

In the fourth aspect, the reactor can be used as a single-phase reactor.

Though the present invention has been described using representative embodiments, a person skilled in the art would understand that the foregoing modifications and various other modifications, omissions, and additions can be made without departing from the scope of the present invention.

The invention claimed is:

1. A reactor, comprising:

a core body, wherein the core body comprises an outer peripheral iron core composed of a plurality of outer peripheral iron core portions, at least three iron cores arranged inside the outer peripheral iron core, each of the at least three iron cores are coupled to a respective one of the plurality of outer peripheral iron core portions at a location midway between two ends of the respective one the plurality of outer peripheral iron core portions, and coils which are wound around the at least three iron cores, the radially inner end of each iron core converges toward the center of the outer peripheral iron core, gaps are formed between one of the at least three iron cores and another iron core adjacent thereto through which gaps the iron cores are magnetically connectable, a point of intersection of the gaps is positioned in the center of the core body, and the core body is rotationally-symmetrically formed about the center thereof, and the reactor further comprises a single temperature detection part arranged in the center of the core body at the point of intersection of the gaps.

2. The reactor according to claim 1, wherein the at least three iron cores of the core body are rotationally-symmetrically arranged.

3. The reactor according to claim 1, wherein the number of the at least three iron cores is a multiple of three.

4. The reactor according to claim 1, wherein the number of the at least three iron cores is an even number not less than four.

5. A reactor, comprising:

a core body, wherein the core body comprises an outer peripheral iron core composed of a plurality of outer peripheral iron core portions, at least three iron cores arranged inside the outer peripheral iron core, each of the at least three iron cores are coupled to a respective one of the plurality of outer peripheral iron core portions at a location midway between two ends of the respective one the plurality of outer peripheral iron core portions, and coils which are wound around the at least three iron cores, the radially inner end of each iron core converges toward the center of the outer peripheral iron core, gaps are formed between one of the at least three iron cores and another iron core adjacent thereto, through which gaps the iron cores are magnetically connectable, a point of intersection of the gaps is positioned in the center of the core body, and the core body is rotationally-symmetrically formed about the center thereof, and the reactor further comprises a single temperature detection part arranged inside the core body on a center line of the core body at the point of intersection of the gaps.

6. The reactor according to claim 5, wherein the at least three iron cores of the core body are rotationally-symmetrically arranged.

7. The reactor according to claim 5, wherein the number of the at least three iron cores is a multiple of three.

8. The reactor according to claim 5, wherein the number of the at least three iron cores is an even number not less than four.

* * * * *